United States Patent [19]

Wickersheim

[11] 4,107,903

[45] Aug. 22, 1978

[54] FULLY AUTOMATIC DEVICE FOR PACKING PIECE GOODS, IN PARTICULAR FRUITS

[75] Inventor: August Wickersheim, Rellingen, Germany

[73] Assignee: Wickersheim & Johne Maschinen-und Verpackungsanlagen GmbH, Rellingen, Germany

[21] Appl. No.: 765,193

[22] Filed: Feb. 3, 1977

[30] Foreign Application Priority Data

Feb. 3, 1976 [DE] Fed. Rep. of Germany ... 7602840[U]

[51] Int. Cl.[2] ..... B65B 61/26; B65B 1/06

[52] U.S. Cl. ..... 53/138 A; 53/198 A

[58] Field of Search ..... 53/138 A, 198 A

[56] References Cited

U.S. PATENT DOCUMENTS

| | | | |
|---|---|---|---|
| 3,129,548 | 4/1964 | Gibbons | 53/198 A |
| 3,726,060 | 4/1973 | McMillan | 53/138 A |

*Primary Examiner*—Travis S. McGehee

*Attorney, Agent, or Firm*—Toren, McGeady and Stanger

[57] ABSTRACT

A fully automatized packing apparatus for bulk articles or goods such as fruits in which the goods to be bagged are supplied through a filling tube and a length of packing material in the form of a continuous hose is withdrawn from a packing material supply on the filling tube, the apparatus including a movable carriage with handling devices for automatically gathering up the hose into a narrow compact strand and introducing this hose strand into the closing and severing assembly.

5 Claims, 3 Drawing Figures

Figures 1, 2, 3:
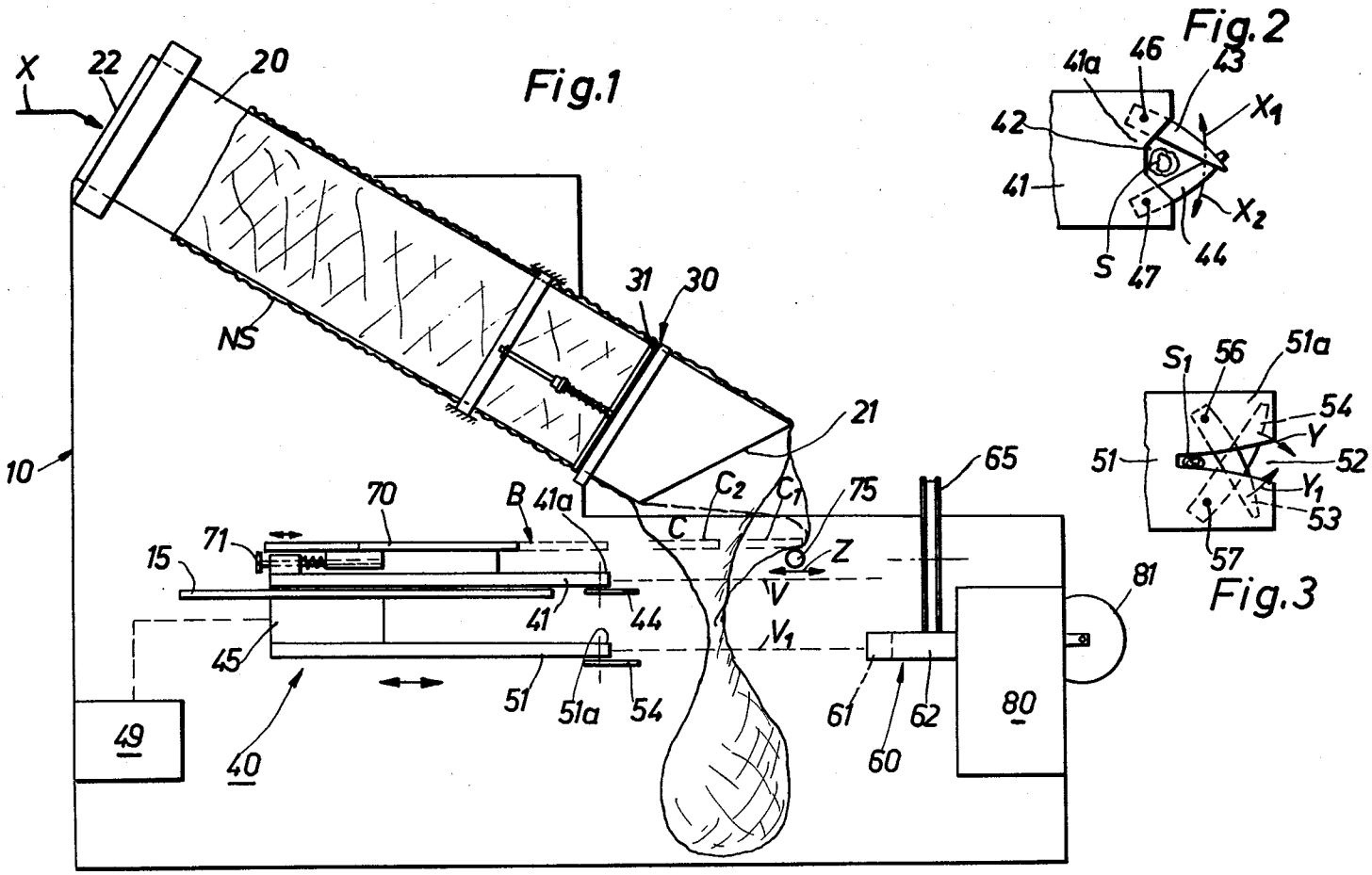

10
15
20
21
22
30
31
40
41
41a
42
43
44
45
46
47
49
51
51a
52
53
54
56
57
60
61
62
65
70
71
75
80
81
NS
X
X1
X2
Y
Y1
S
S1
B
C
C1
C2
Z
V
V1

FULLY AUTOMATIC DEVICE FOR PACKING PIECE GOODS, IN PARTICULAR FRUITS

The present invention relates to a fully automatic apparatus for packing discrete goods such as fruits which apparatus includes a machine frame with a filling tube adapted to receive a relatively large supply of a telescopically pushed together mesh type hose material, an assembly for restraining the hose supply during withdrawal of this packing material from the filling tube associated with the filling tube, the restraining assembly having a brake ring, an assembly for closing a hose section gathered into the shape of a strand by means of ribbon clips encircling the hose strand to define a bottom closure for a subsequent hose section overlying a filling tube discharge outlet, in combination with means for severing a completed package intermediate the closure points, the closing and severing assembly being arranged downstream of the filling tube, and means controlled by the closing and severing assembly for introducing ribbon shaped portions into the space between the hose strand and the ribbon clips encircling the same during the closing operation and for printing price and/or advertising indicia onto the ribbon shaped portions.

There are already known various apparatus of this type. The heretofore known apparatus are of a design in which may be effected the formation of the package, the gathering up and stretching of the packing hose, the manufacture of the closure clips and the severing of the packages closed at their two ends intermediate a pair of closure clips by means of suitably arranged mechanical devices. In some embodiments, however, these operations must be performed manually whereas in other embodiments may be provided an automatic control for these various operations.

For eliminating the disadvantage encountered in fully automatic apparatus of this type such as lack of careful treatment of the packing material during the filling operation, there has already been proposed a semi-automatic packaging apparatus in which the filling tube is slightly inclined with respect to a working table on which is arranged, laterally of the filling tube discharge outlet and spaced therefrom as required for manual handling of the package, the closing and severing assembly adapted to apply ribbon clips about the hose web and provided with means for retaining an inserted and manually gathered and stretched packing material hose. This heretofore known apparatus is of a substantially horizontal overall structure whereby the goods discharged from the filling tube discharge outlet are advanced manually along the working table during the formation of the package. At any rate there are required numerous manual operations in this heretofore known apparatus so that one or more operators are required. Moreover, a semi-automatic apparatus of this type does not permit high output speeds. All in-line auxiliary devices upstream of the packing apparatus such as sorting or weighing devices must be adapted to the working cycle of the operator. If the operator intends to increase his working speed, then a careful handling of the material packed is no longer ensured since when speeding up the various manipulations attention with respect to careful treatment of the goods will have necessarily to be neglected.

Furthermore there has already been proposed a fully automatic apparatus for packing discrete goods such as fruits into a hose type packing material, this apparatus including an inclined filling tube serving as a mounting tube for receiving a hose supply and coupled to a carriage adapted to be moved by a drive mechanism. This apparatus includes a brake ring for restraining the hose supply along the movable mounting tube by means of solenoids during advance movements of the mounting tube and the filling operation. Below the filling tube discharge outlet is arranged a transport ring that is movable in a horizontal direction in the machine frame and is controlled by the drive mechanism of the closing and severing assembly. The transport ring surrounds a hose section withdrawn from the mounting tube and includes a reduced diameter entrainment section for establishing a hose web or strand. The closing head of the closing and severing assembly is disposed below the transport ring and in the feed track of the entrainment member. In this heretofore known apparatus the gathering up of the hose section into a hose web and the introduction of the gathered up hose web into the closing head of the closing and severing assembly is effected by means of pivot levers at the closing and severing assembly, and there pivot levers serve to pull the hose web into the closing head in simultaneously gathering up the hose material.

Furthermore there has been proposed a packing apparatus including an annular feed tray rotatably movably mounted about a vertical axis and driven continuously or intermittently by a drive mechanism. The feed tray includes at least one peripheral rigidly mounted collector container for receiving weighed or counted quantities of fruits. A discharge aperture of the collector container may be opened or closed by a pivotably mounted closing lid movable by an associated actuator. At the bottom plate of the feed tray is arranged at least one pair of spaced inclined filling tubes the discharge ends of which open into the feed tray. In the internal cavity of the feed tray is arranged at least one stationary transfer member for transferring the fruits from the collector container into the entry opening of the filling tube that is at this very moment closest to the collector container. The transfer member is disposed downstream of the collector container with respect to the direction of rotation of the feed tray. A closing and severing assembly is stationarily mounted adjacent the path of rotation of the bottom filling tube ends, and with the closing head thereof is associated a guide plate defining a guide track extending in a direction parallel to the path of rotational movement of the filling tubes and opening into the closing head. The guide track is of a slot shaped configuration for receiving the web like hose section intermediate a portion overlying the filling tube and a portion filled with fruits. An assembly for stretching and introducing the hose section into the closing head is disposed in front of the closing head. A rotary disc driven by a drive mechanism is arranged below the filling tube bottom ends. A stationary transfer member for removing or respectively transferring filled individual packages onto a discharge conveyor is disposed above the disc and downstream of the closing head. A control assembly serves to control the operational cycles of the drive mechanisms for the closing lid at the collector container, the feed tray, the transfer member, the closing and severing assembly, the assembly for stretching and introducing the hose section into the closing head and the discharge disc in a manner so that upon opening the collector container and transferring the fruits into the feed tray and into the most proximate filling tube this filling tube may be moved into the working range of the closing and severing assembly, the filled bag may be gathered up, sealed and separated from the hose material remaining on the filling tube. In this prior art embodiment of the gathering up of the hose section is performed in the region of the closure members applied, in employing a stationary guide plate having a guide slot and a pivot lever for introducing a hose section that has to be gathered up into this guide section, passing this hose section through this guide section and effecting simultaneously the gathering up of this hose section.

There is furthermore known a fully automatic apparatus for packing discrete goods such as sensitive fruits e.g. tomatoes or the like. This heretofore known apparatus includes a filling tube for receiving a relatively large supply of a telescopically pushed together mesh type hose material and associated therewith an assembly for restraining the hose supply during withdrawal of this packing material from the filling tube wherein this assembly includes a brake ring. Downstream of the filling tube is provided an assembly for closing a hose section gathered into the shaped of a strand by means of ribbon clips encircling the hose strand to define a bottom closure for a subsequent hose section overlying the filling tube discharge outlet, and for severing a completed package intermediate the closure points. A sleeve is longitudinally movable along the outside of the filling tube. This sleeve extends about the full circumference of the filling tube but is shorter than the latter. The sleeve bears at one end the brake assembly for the hose supply. The filling tube is mounted in the machine frame in a horizontal lying position. A transport conveyor extends through the internal cavity of the filling tube from the discharge outlet to and beyond the inlet opening at which end the transport conveyor defines a receiving portion. The transport conveyor is operated by a drive mechanism. The conveyor end extending from the filling tube inlet end is arranged on a vibrating table. The closing head of the closing and severing assembly is disposed below the filling tube discharge outlet, and a finger shaped packing hose gathering device underlies the closing head and is adapted to be moved in the longitudinal direction of the filling tube. This finger shaped packing hose gathering member is mounted within the apparatus in a manner so that the hose web portion above the filled package will be introduced into the entry slot of the closing head of the closing and severing assembly by movement of the packing hose gathering member. For retaining the packing hose gathering member the machine frame includes a cantilever type guide member in which are arranged the drive means for moving the packing hose gathering member. Drive mechanisms and crank assemblies are provided for moving the packing hose gathering member. In another embodiment of this heretofore known fully automatic apparatus for packing discrete goods the packing hose gathering member is moved toward the closing head of the closing and severing assembly for closing the hose material taken up into the form of a web or strand by means of ribbon clips applied about this web or strand whereby simultaneously the taken up netting hose will be entrained, due to the finger shaped configuration of the packing hose gathering member and will be moved into the entry slot of the closing head of the closing and severing assembly.

A drawback of all heretofore known embodiments of packing apparatus for discrete goods, particularly fruits in which price tags are clamped concurrently when applying the ribbon clips is that the gathering up of the hose web is insufficient so that the last gathering operation must be performed when applying the ribbon clips by the closing and severing assembly. This entrains the further drawback that the ribbon shaped price tags introduced simultaneously prior to applying the ribbon clips will not be arranged sufficiently firmly within the gathered up portion so that when applying the ribbon clips the price tags inserted will in many cases not be attached securely enough by this clamping operation. Another drawback is that the price tags, due to the loose retention in the region of the gathered up hose section, may assume different positions so that the attached price tags are orientated in various directions in the finished packages.

It is an object of the present invention to provide a novel and improved fully automatic apparatus for packing discrete goods such as particularly fruits.

It is another object of the present invention to provide an apparatus of the above type ensuring a faultless withdrawal of a hose section from a rigidily mounted filling tube and a perfect introduction of the gathered up hose section into the entry slot of the closing and severing assembly, as well as a perfect insertion of the printed ribbon section into the closing region and the positive retention therein, and allowing to fill bags of different lengths.

For achieving the above objects, there is now proposed, in accordance with the present invention, a fully automatic apparatus for packing discrete goods such as fruits, the apparatus including a machine frame with a filling tube adapted to receive a relatively large supply of a telescopically pushed together mesh type hose material, an assembly for restraining the hose supply during withdrawal of this packing material from the filling tube associated with the filling tube, the restraining assembly having a brake ring, an assembly for closing a hose section gathered into the shape of a strand by means of ribbon clips encircling this hose strand to define a bottom closure for a subsequent hose section overlying a filling tube discharge outlet, in combination with means for severing a completed package intermediate the closure points, the closing and severing assembly being arranged downstream of the filling tube, and means controlled by the closing and severing assembly for introducing ribbon-shaped portions into the space between the hose strand and the ribbon clips encircling the same during the closing operation and for printing price and/or advertising indicia onto the ribbon shaped-portions. The improvements in this apparatus consist in a carriage movably mounted in the machine frame underneath the filling tube and coupled to a drive mechanism, the carriage includes a pair of mutually spaced mounting plates overlying each other, the mounting plates facing the closing and severing assembly are provided with end portions having hose web take-up recesses, and in the vicinity thereof a pair of finger shaped gathering arms rotatably mounted about an associated vertical pivot axis, the closing and severing assembly includes a closing head defining an entry slot for the hose web in the path of movement of the lower supporting plate, the feed track of the lower supporting plate is below the feed track of the upper supporting plate, and the movements of the pair of supporting plates are being positively controlled by the carriage drive mechanism during advance movements of the carriage.

For enabling to introduce the gathered up hose strand into the entry slot of the closing and severing assembly and for maintaining this gathered up condition in the region of this entry slot, the hose web take-up recess of the lower supporting plate is of a greater depth than the hose web take-up recess of the upper supporting plate, and is of a slot-shaped configuration.

To allow the filling and sealing of packages of different lengths, the present invention proposes, according to a still further characteristic, a withdrawal plate arranged on the upper supporting plate of the carriage, the withdrawal plate being parallel with respect to the supporting plates, the longitudinal distance of movement of the withdrawal plate in a direction parallel of the feed direction of the carriage being adapted to be varied, and a stationary rod type withdrawal arm extends perpendicularly of the carriage feed track and is provided below the feed track of the withdrawal plate adjacent the filling tube discharge outlet and in front of the closing and severing assembly.

In this fully automatic apparatus for packing discrete goods, particularly fruits, having a movable carriage with finger shaped gathering arms at its end facing the closing and severing assembly it is possible to take up or "gather" the hose section intended to be sealed within a minimum of space whereby the upper pair of gathering arms provides for an initial or "pre-gathering" whereas the lower pair of gathering arms of the carriage provides for the final gathering condition and maintains this condition during application of the ribbon clips by means of the closing and severing assembly so that the price tags simultaneously introduced during the gathering up operation will be retained in an unshiftable manner during the closing and severing step. Since the carriage is provided with a withdrawal plate adapted to be moved in a horizontal direction through predetermined paths of movement, and this withdrawal plate cooperates with a stationary withdrawal arm extending perpendicularly of the feed track of the carriage there may be provided bags of various lengths, and these bags may be filled and closed without the necessity of major rearrangements in the apparatus. A displacement of the withdrawal plate along the carriage by means of the worm drive assembly is sufficient to adapt the apparatus to any desired length of bag.

In the following the present invention will be described more in detail with reference to the appended drawing wherein FIG. 1 is a lateral elevational view of the packing apparatus in accordance with the present invention having an inclined filling tube holding a supply of mesh type hose material and two pairs of finger shaped gathering arms mounted on a movable carriage at the carriage end facing the closing and severing assembly;

FIG. 2 is a fragmentary top view of the gathering arms arranged in the upper region of the movable carriage; and FIG. 3 is a fragmentary top view of the gathering arms arranged in the lower region of the movable carriage.

Referring to FIG. 1, the packing apparatus of the present invention consists of a box shaped machine frame 10 that may be mobile by means of roller feet not shown in the drawing.

In this machine frame 10 is mounted a filling tube 20 at a relatively small inclination with respect to the horizontal plane. The filling tube 20 defines a filling tube discharge outlet 21 and a filling tube inlet 22. Discrete goods intended to be packed are supplied to the filling tube 20 in the direction of the arrow *x*. The filling tube 20 serves to receive a supply of netting or mesh type hose material NS. Alternatively, the machine frame 10 may likewise be provided with a rotary disc the rotary axis of which is inclined with respect to the surface supporting the machine frame 10, instead of a single filling tube 20. Such a rotary disc may comprise mountings for receiving a pair of superimposed filling tubes one of which is continuously pivoted into the operational position whereas the other of which will be rotated into the operational position of the packing apparatus when the available hose supply has been withdrawn from the filling tube. The filling tube which at any moment has been rotated into the upper position and no longer provides a hose supply will in this upper position be provided with a netting hose supply. Toward this end, the filling tubes may be disassembled from the rotary disc.

The filling tube 20 is provided with a conventional assembly for restraining the hose supply during withdrawal of the packing material from the filling tube. This restraining assembly may consist of a sleeve surrounding the filling tube and adapted to be moved along the filling tube 20 by means of an actuator not shown in the drawing. This sleeve receives a supply of mesh type hose material NS. When the filling tube 20 has been filled with goods intended to be packed, the actuator is operated so that from the filling tube 20 will be automatically withdrawn a quantity of mesh type hose material as required for the packing actually intended to be established. The control of the actuator or of the restraining assembly respectively may consist e.g. of a brake ring, as indicated at 31. This brake ring is controlled by a closing and severing assembly 60 arranged in the vicinity of the filling tube discharge outlet and described further below. Alternatively, the above described hose material restraining assembly may be replaced by restraining or braking means of a different design or type.

A closing and severing assembly 60 with a closing head indicated at 62 is mounted in the vicinity of the filling tube discharge outlet 21. The closing and severing assembly 60 is mounted in the machine frame 10 in a manner so that a filled bag may be closed in the vicinity of the filling tube discharge outlet 21. The closing and severing assembly 60 comprises the closing head 62 with an entry slot 61 into which may be introduced a hose section gathered up into the shape of a hose web or hose strand by means of a device described further below, and of clip closing dies. This assembly furthermore includes stamping dies that are movable with respect to the closing dies and are coupled to a drive mechanism not shown in the drawing. With each stamping die are associated a positive advance member and a bending bolt. These advance members are guided along the upper or respectively lower sides of the stamping dies and are adapted to be intermittently coupled to these stamping dies during their closing movement by means of coupling members with entrainment parts pivotable into recesses of the guide. The advance member serves to sever lengths of ribbon that are fed by rollers from a magazine drum 65. The bending bolts serve to deform the lengths of ribbon into a U shape about control means mounted at the advance members and in the path of movement of the stamping dies. A cutting knife intermediate the stamping dies serves to sever the hose section between the two closure points.

An actuating lever is disposed in the entry slot 61 of the closing head 62 and serves to actuate the drive mechanism for the stamping dies. The closing and severing assembly may likewise be of a different design.

In the machine frame 10 is furthermore mounted a conventional printing device 80 for imprinting ribbon shaped sections with price and/or advertising indicia. The printing device includes means for introducing these ribbon shaped sections into the space between the hose web or strand and the ribbon clips applied thereabout during the closing operation. This price tag printer 80 with its corresponding printing mechanism is preferably mounted on a mounting arm or a mounting plate together with the closing and severing assembly 60, and this mounting arm or plate is mounted in the machine frame 10 so that the assembly may be rotated away from the filling tube discharge outlet 21. The reference numeral 81 indicates a supply reel for ribbon material for making the price tags.

For taking or gathering up the hose section above the filling goods upon completion of the filling operation, the machine frame 10 includes a carriage 40 movable in horizontal direction along a guide track 15 underneath the filling tube 20. The movements of the carriage 40 are controlled by a drive mechanism 49.

The carriage 40 includes a pair of horizontal supporting plates 41, 51 held at a mutual spacing by a spacer block 45. The front ends 41*a*, 51*a* of the supporting plates 41, 51 respectively facing the closing and severing assembly 60 are each provided with a hose web take-up recess 42, 52 respectively (FIGS. 2 and 3). The hose web take-up recess 52 of the supporting plate 51 is of a slot shaped configuration and of a greater length than the hose web take-up recess 42 at the front end of the supporting plate 41. Both supporting plates 41, 51 include, at their front ends 41*a*, 51*a*, in the vicinity of the respective hose web take-up recess 42, 52 respectively, a pair of finger shaped gathering arms 43, 44 and 53, 54 respectively. These gathering arms may be pivoted about a vertical pivot axis 46, 47 and 56, 57 respectively in the direction of the arrow $x_1$, $x_2$ and $y$, $y_1$ respectively. The finger shaped gathering arms 43, 44 and 53, 54 are mounted on the supporting plates 41, 51 on both sides of the hose web take-up recesses 42, 52 in a manner so that in the open position of the gathering arms 43, 44 and 53, 54 the hose section will be gripped and taken up above the filled bag when the gathering arms 43, 44 and 53, 54 are rotated toward each other. The gathering arms 43, 44 effect an initial or pre-gathering up in the upper region of the hose strand section to be gathered up whereas the gathering arms 53, 54 serve to take up the hose strand portion into a minimum space (FIG. 3). In FIGS. 2 and 3 the gathered up hose sections are indicated by S and S1 respectively.

The overall arrangement of the carriage 40 with the pair of supporting plates 41, 51 and the finger shaped gathering arms 43, 44 and 53, 54 with respect to the closing and severing assembly 60 is such that when moving the carriage 40 toward the closing and severing assembly 60 a length of mesh type hose material required for filling a succeeding bag will be withdrawn from the mesh type hose material supply NS on the filling tube 20 by means of the hose strand section introduced into the hose web take-up recess 42 of the upper supporting plate 41, in simultaneously closing the gathering arms 43, 44. The feed track or path of movement of the supporting plate 41 is indicated at V. The closing head 62 of the closing and severing assembly 60 is disposed below this feed track V of the supporting plate 41.

During movement of the carriage 40 toward the closing and severing assembly 60 the hose strand section disposed below the supporting plate 41 is introduced into the hose web take-up recess 52 and is taken up by means of the gathering arms 53, 54 moving toward each other. Prior to this taking up operation the printing device 80 introduces the ribbon material for forming the price tags so that during the taking up operation the price tag will be concurrently integrated into the closing point. The entry slot 61 of the closing head 62 of the closing and severing assembly 60 is arranged in the feed track V1 of the supporting plate 51 in a manner so that the taken up hose section S1 will be introduced into the entry slot 61 and will be retained therein during the closing operation by the gathering arms 53, 54. The entry slot 61 of the closing head 62 of the closing and severing assembly 60 is thus disposed along the feed track V1 of the supporting plate 51.

The rotational movement of the finger shaped gathering arms 43, 44 and 53, 54 at the front end portions of the supporting plates 41, 51 is positively controlled by the drive mechanism 49 for the carriage 40 by means of control devices not shown in the drawing.

In order to allow the formation and filling of bags of various lengths, the carriage 40 includes a horizontally mounted withdrawal plate 70 the feed track or path of movement of which is indicated at V2. This withdrawal plate 70 is mounted on the carriage 40 in a manner so that the longitudinal movement of the withdrawal plate 70 may be varied by means of a worm drive assembly indicated at 71. When e.g. moving the withdrawal plate 70 by means of the worm drive 71 into the position B, then a longer hose section will be withdrawn from the hose supply on the filling tube 20, and this operation is effected in combination with a rod type withdrawal arm 75 mounted in the machine frame 10 in the region of the closing head 62 of the closing and severing assembly 60 and below the feed track V2 of the withdrawal plate 70 transversely of the path of movement of the withdrawal plate. When advancing the carriage 40 the withdrawal plate 70 assumes the position C shown in FIG. 1 so that a greater length of hose section will be withdrawn from the filling tube as compared to a position of the withdrawal plate 70 in which the front edge of the latter does not move up to the point C1 but merely up to the point C2, as shown in FIG. 1.

The operation of the fully automatic apparatus for packing discrete goods in accordance with the present invention is as follows:

Upon completion of the filling operation of a bag section wherein the bag has previously been closed at its bottom end by the preceding closing and severing step, the drive mechanism 49 moves the carriage 40 toward the closing and severing assembly 60. Simultaneously the gathering arms 43, 44 and 53, 54, which are in their open or spread apart position, grip the hose section above the filled bag and introduce the same into the hose web take-up recesses 42, 52 during further advance movement of the carriage 40 with its supporting plates 41, 51. During the further advance movement of the carriage 40 the gathering arms 43, 44 and 53, 54 are simultaneously closed. During this advance movement of the carriage 40 a length of hose material as required for defining a next following bag will be withdrawn from the hose supply NS on the filling tube 20, and the length of hose withdrawn is thereby predetermined by means of the position of the withdrawal plate 70. The taken up hose section S1 (FIG. 3) is introduced into the entry slot 61 of the closing head 62 of the closing and severing assembly 60 during this advance movement of the carriage 40, and the price tag is introduced prior to the completion of the hose taking up operation. Within the entry slot 61 the hose section S1 is retained in taken-up position by the closed gathering arms 53, 54, in combination with the slot shaped configuration of the hose web take-up recess 52 so that when applying the ribbon clips the price tag cannot be displaced nor become loose.

Instead of the variable adjustment of the longitudinal movement of the carriage 40 it is also possible to mount the rod type withdrawal arm 75 so as to be movable in a horizontal direction, as indicated by the double headed arrow Z in FIG. 1. The movability of the withdrawal arm 75 allows to vary the length of the hose section intermediate the filling tube discharge outlet and the filled bag section or bag end respectively, i.e. to adapt the length of a hose section being filled to the actual filling quantity.

I claim:

1. A fully automatic apparatus for packing discrete goods such as fruits, including a machine frame with a filling tube adapted to receive a relatively large supply of a telescopically pushed together mesh type hose material, an assembly associated with said filling tube for restraining said hose material supply during withdrawal of the material from said filling tube, said restraining assembly having a brake ring, an assembly for closing a hose section gathered into the shape of a strand by means of ribbon clips encircling said hose strand to define a bottom closure for a subsequent hose section overlying a filling tube discharge outlet, in combination with means for severing a completed package intermediate the closure points, said closing and severing assembly being arranged downstream from said filling tube relative to the direction of movement of the goods from said filling tube into the hose material, and means controlled by said closing and severing assembly for introducing ribbon shaped portions into the space between said hose strand and the ribbon clips encircling the same during the closing operation and for printing price and/or advertising indicia onto said ribbon shaped portions, wherein the improvement comprises a drive mechanism, a carriage (40) movably mounted in said machine frame (19) underneath said filling tube (20) and coupled to said drive mechanism (49) for movement in the horizontal direction, said carriage including a pair of vertically spaced supporting plates (41, 51) one positioned above the other, an end portion of each of said supporting plates facing said closing and severing assembly (60) with said end portions facing said closing and severing assembly **(41*a*, 51*a*) each having a hose web take-up recess (42, 52) and in the vicinity thereof each having a pair of finger shaped gathering arms (43, 44; 53, 54) rotatably mounted about an associated vertical pivot axis (46, 47; 56 57) for movement transversely across the associated recess, said closing and severing assembly (60) including a closing head (62) defining an entry slot (61) for said hose web facing toward said take-up recesses in the path of movement (V1) of the lower one of said supporting plates (51), the feed track of said lower supporting plate disposed below the feed track (V) of the upper one of said supporting plates (41)**, and the movement of said pair of supporting plates being positively controlled by said carriage drive mechanism during advance movements of said carriage.

2. A fully automatic apparatus as defined in claim 1 wherein said hose web take-up recess (52) of said lower supporting plate (51) is of a greater depth inwardly from said end portion thereof facing said closing and severing assembly than the hose web take-up recess (42) of said upper supporting plate (41), and is of a slot shaped configuration.

3. A fully automatic apparatus as defined in claim 2 wherein a withdrawal plate (70) is arranged on the upper supporting plate (41) of said carriage (40), said withdrawal plate being parallel with respect to said supporting plates (41, 51), the longitudinal distance of movement of said withdrawal plate in a direction parallel of the feed direction of said carriage being variable, and a stationary rod type withdrawal arm (75) extending perpendicularly of said carriage feed track is provided below the feed track (V2) of said withdrawal plate (70) adjacent the end of said filling tube from which the hose material is withdrawn and between the end of said filling tube and said closing and severing assembly (60).

4. A fully automatic apparatus as defined in claim 1 wherein a worm drive assembly (71) is connected to said withdrawal plate for adjusting the longitudinal extension of said withdrawal plate on said carriage (40).

5. A fully automatic apparatus as defined in claim 3 wherein said carriage (40) is stationarily mounted, and said rod type withdrawal arm (75) is movable in the horizontal direction.

* * * * *